US005845745A

United States Patent [19]

Lane

[11] Patent Number: 5,845,745

[45] Date of Patent: Dec. 8, 1998

[54] CABLE DRUM TYPE RESIDENTIAL ELEVATOR SYSTEM

[75] Inventor: John R. Lane, Mokena, Ill.

[73] Assignee: D.A. Matot, Inc., Bellwood, Ill.

[21] Appl. No.: 739,833

[22] Filed: Oct. 30, 1996

[51] Int. Cl.[6] ..... B66B 11/00

[52] U.S. Cl. ..... 187/259; 187/406

[58] Field of Search ..... 187/259, 256, 187/239, 406, 261, 266, 245, 258, 414

[56] References Cited

U.S. PATENT DOCUMENTS

| | | | |
|---|---|---|---|
| 524,344 | 8/1894 | McLauthlin et al. | 187/259 |
| 1,270,716 | 6/1918 | Flannery | 187/259 |
| 3,260,330 | 7/1966 | Stewart | 187/3 |
| 3,292,737 | 12/1966 | Crispen et al. | 187/31 |
| 3,606,459 | 9/1971 | Sedgwick | 165/9 |
| 3,650,317 | 3/1972 | Barnard et al. | 297/149 |
| 3,846,939 | 11/1974 | Weaver | 49/370 |
| 4,476,772 | 10/1984 | Gorman et al. | 92/168 |
| 5,129,485 | 7/1992 | Hoch | 187/20 |
| 5,205,379 | 4/1993 | Pfleger | 187/406 |
| 5,351,787 | 10/1994 | Hoch et al. | 187/253 |

FOREIGN PATENT DOCUMENTS

| | | | |
|---|---|---|---|
| 343096 | 6/1956 | Switzerland | 187/239 |

*Primary Examiner*—Kenneth Noland

*Attorney, Agent, or Firm*—Lee, Mann, Smith, McWilliams, Sweeney & Ohlson

[57] ABSTRACT

A cable drum type elevator system for residential low-rise use. The elevator includes: a vertically extending support-rail system, an elevator cab mounted thereon for vertical movement, lifting machinery mounted to the support-rail system and cables operated by the lifting machinery and secured to the cab for raising and lowering the cab on the support-rail system. The support-rail system is supported at its lower end and secured to a ground position. A foot assembly is secured to the rail support system and to the ground to cooperate in supporting the support rail system. The foot assembly extends below the elevator cab. The lifting machinery is mounted to the support rail system at its upper end. A dampening system is used in the lifting machinery connection to the support-rail system to minimize system vibration due to the machinery. A clutch-like braking system associated with the lifting machinery permits the elevator cab to be safely lowered to the next lower floor in the event of an external power failure to the lifting machinery.

4 Claims, 5 Drawing Sheets

FIG. 2
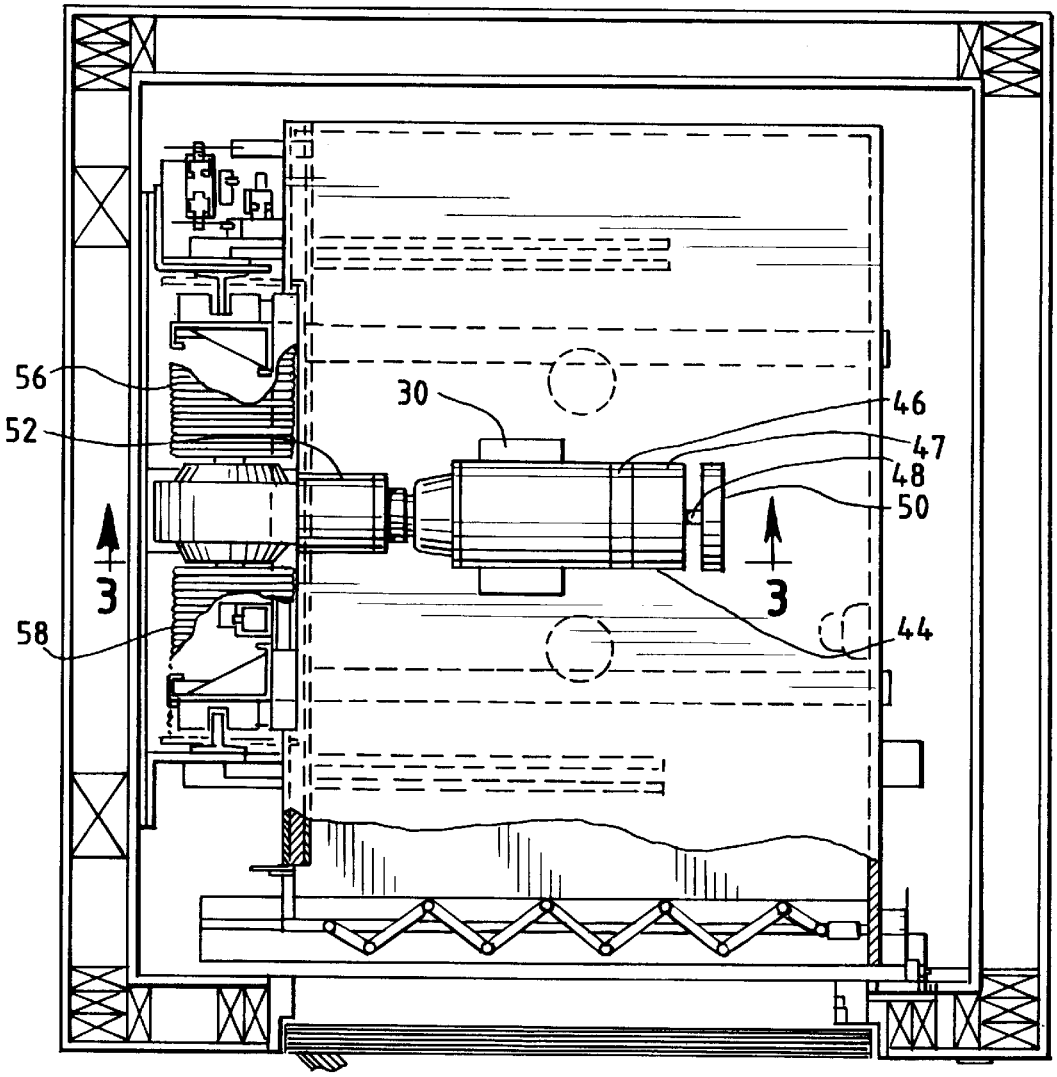
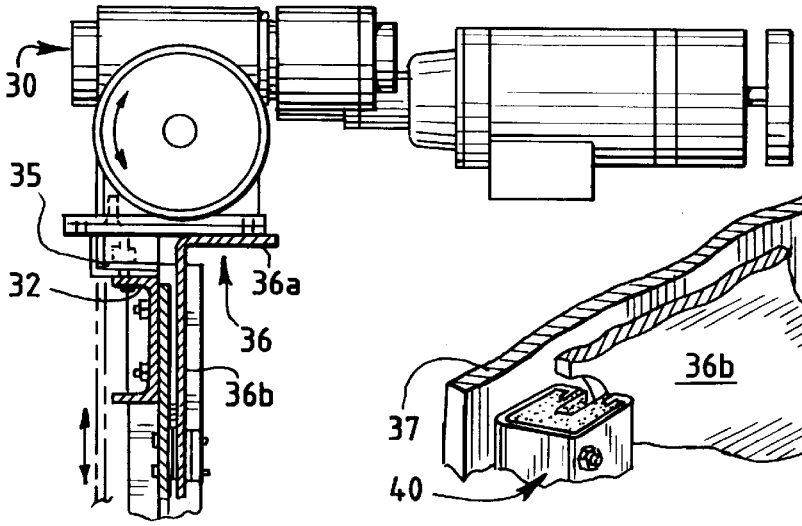
FIG. 3
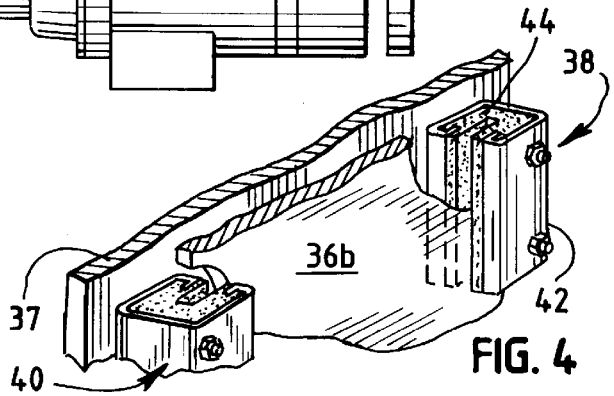
FIG. 4

FIG. 9
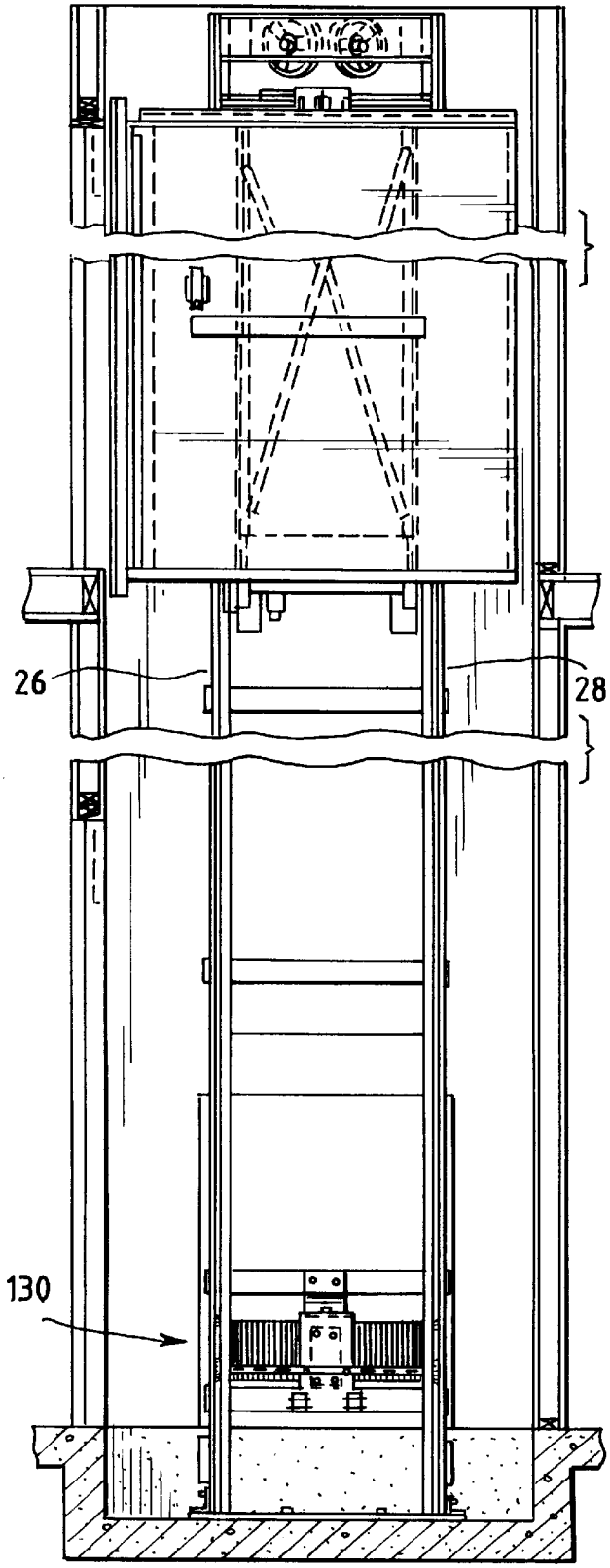
FIG. 10
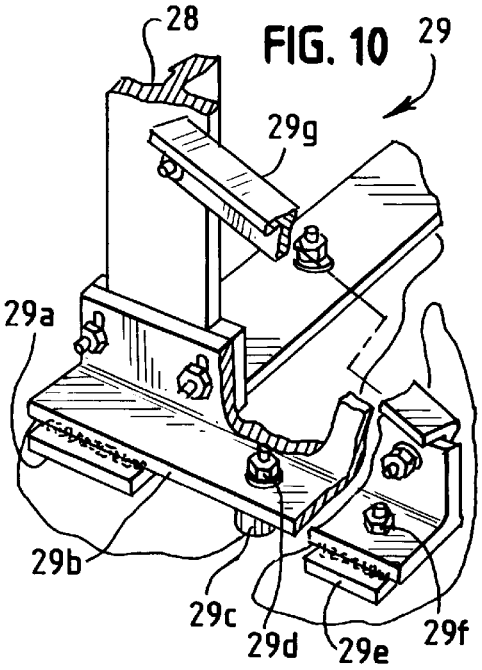
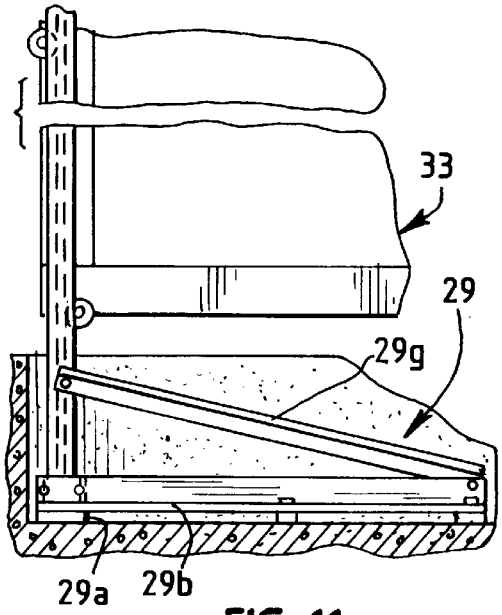
FIG. 11

CABLE DRUM TYPE RESIDENTIAL ELEVATOR SYSTEM

BACKGROUND OF THE INVENTION

This invention relates to a cable drum type elevator system for residential and other uses and, in particular, to a support system for supporting the elevator system, positioning of the lifting machinery at the top or the lower portion of the elevator system, a clutch-like brake for controlling the downward speed of the elevator cab in the event of an external power failure, and an isolating and dampening mechanism for preventing vibrations from the lifting machinery from travelling throughout the elevator.

Cable drum elevator systems are known in the art. These are elevator systems which are used and normally have a rise or vertical movement of two or five stories, for example, from the basement to the first floor or to a fifth floor. This may amount to a 2 to 50 foot rise.

Usually the hoistway for the elevator system is constructed within the building. The hoistway may be formed using an existing area or be specially designed into the house.

The elevator system includes a support or rail structure that is secured to the house's framing and provides a guide along which an elevator cab moves. Under normal conditions, the lifting machinery, which lifts the elevator cab via a cable system, is positioned at the lower level so as to be readily accessible for maintenance and repair. It has also been found that in these elevator systems, vibrations from operation of the lifting machinery tends to travel throughout the elevator system. This may be due to the nature and operation of the lifting machinery. Moreover, it has been found that in the event of a power failure, the elevator system's regular automatic brake operates to stop the elevator cab at whatever position it is then located. It is probable that the position is between residence floors.

Referring to the issue of support, at present the rail structure and lifting machinery are secured to the framing of the house. This means that if the connection becomes loose, the integrity of the elevator system may be jeopardized. Such loosening can result from settling of the house, operation of the elevator system over time or vibrations induced by the machinery.

It is an object of this invention to capture cable loads within the rail structure and to support the rails at the bottom of the house. Moreover, the rails are to be connected to the house only for positioning purposes.

The lifting machinery for the elevator system is usually placed in a lower and adjacent machinery room. In this arrangement, the machinery is accessible for maintenance and repair. However, the machinery room takes up space that is useable for other purposes and it is desirable to, if possible, eliminate that adjacent room but still permit maintenance of the machinery.

It is therefore an object of this invention to provide structure for supporting the lifting machinery and to minimize the space necessary to maintain the machinery and, optionally, to eliminate the adjacent machinery room.

In the event of a power failure, the automatic braking associated with lifting machinery will stop the operation of the lifting machinery and stop the elevator cab. When the elevator is stopped it may be positioned between floors and it is therefore inconvenient or impossible for elevator cab occupants to leave the elevator cab.

A telephone within the cab permits a cab occupant to contact a serviceman or others who can move the cab from one floor to another. If the automatic brake was not activated and the cab was permitted to move downwards, it is possible that the downward velocity or terminal impact of the elevator cab could cause personal injury or damage.

It is an object of this invention to provide a mechanism whereby, in the event of an external power failure, the automatic braking mechanism can be disengaged and the cab safely lowered to the next available stop where the automatic braking mechanism can be reengaged. Thus, the elevator occupant would not need to contact service people in order to lower the cab to a position where the occupant could exit the cab.

The motor associated with the lifting mechanism can produce vibrations which either are transmitted through the rails to the cab or may be transmitted to the house framing and loosen the connections. This may be due to the fact that the lifting motor is a single phase motor which tends to vibrate under load.

It is yet another object of this invention to isolate the motor from other components of the elevator system in such a way as to permit operation while minimizing transmission of undesirable vibrations throughout the system and to the cab occupants.

These and other objects of this invention will become apparent from the following description, the drawings and the appended claims.

SUMMARY OF THE INVENTION

There is provided by this invention improvements in a cable drum type residential elevator system. A hoistway is provided in the residence. The elevator system fundamentally includes a support or rail structure, a cab that is vertically moveable on the support structure, and lifting machinery and cables to cause the cab to move vertically.

There is provided by this invention a pair of vertical support-rail combinations along one side of the cab which are grounded in the basement of the residence and positionally secured in the hoistway. The rail structure can include inwardly extending feet which extend below the elevator cab and are secured to the basement floor. The vertical support-rails help carry the weight of the cab and other components of the elevator system and the cab moves up and down on the rails. The fundamental support for the cab is through the vertical supports and the cable system. These vertical supports and the cable system meet an object of this invention to provide a support structure for the elevator system which is structurally independent of the hoistway and residence but positionally secured therein. The cable loads are also contained in the vertical supports.

Another object of this invention is to eliminate or minimize a machinery room in the basement of the residence or the like. In one embodiment, the machinery necessary to operate the cables to raise and lower the cab can be mounted at the top of the rail structure, thereby eliminating the need for a lower machinery room. This permits the machinery to be serviced at the top of the elevator system rather than in a separate room. In an alternative embodiment, the lifting machinery is secured at a lower position to the vertical supports.

In the event of a power failure, an object of this invention is to permit the cab to be lowered to the next available station and to prevent positioning between the floors.

A clutch-like brake is provided in association with the lifting machinery and specifically the machine motor to permit the motor to rotate in a safe and controlled manner and cables to play out, even if there is an external power failure. In the event of a power failure the automatic brake engages the motor shaft in order to stop the motor, drums, cables and cab. However, the automatic brake can be disengaged by techniques (such as a battery operated circuit) known to one of ordinary skill. This permits the motor, drums and cables to free-wheel and the cab to descend. However, the clutch-like brake remains engaged and operates to limit the maximum speed of the motor and thus, the cab, and permits the cab to safely lower itself to the next available stopping station. At the next stopping station the automatic brake reengages, the cab stops and the occupant can exit.

Another problem that has been identified is the vibration of the motor relative to the cab and support structure. A securement system is provided for the lifting mechanism whereby the lifting mechanism is secured to the support through isolation and dampening members. The construction by which the lifting machinery is secured to the support includes an L-shaped bracket for securing the motor to the support structure, which bracket is connected to the support structure via a pair of dampening clips that include a urethane dampening material. These clips permit the L-shaped bracket to both slide relative to the clips and to move transversely relative to the clips so as to provide a dampening means. The dampening clips resist torque caused by the motor. In addition, an isolating and dampening pad is also provided by which the lifting mechanism is axially connected to the support-rail.

DESCRIPTION OF THE DRAWINGS

FIG. 2 is a plan view of the top of the elevator system in FIG. 1 showing the lifting machinery positioned at the top of the elevator system;

FIG. 3 is a horizontal view taken along lines 3—3 of FIG. 2, showing the lifting machinery and the mounting systems for the lifting machinery to the vertical support rails;

FIG. 4 is an enlarged view showing dampening clips for mounting the lifting machinery to the support;

FIG. 9 is an elevation view of the elevator system as shown in FIG. 8 and taken along the view line in FIG. 8, showing the elevator of FIG. 8;

FIG. 10 is a perspective style view showing a system, partially broken away, for securing the rails at the bottom to a basement floor; and FIG. 11 is a side elevational view showing the bottom part of the rail securement system and its relation to an elevator cab.

DESCRIPTION OF THE PREFERRED EMBODIMENT

Figure 1:
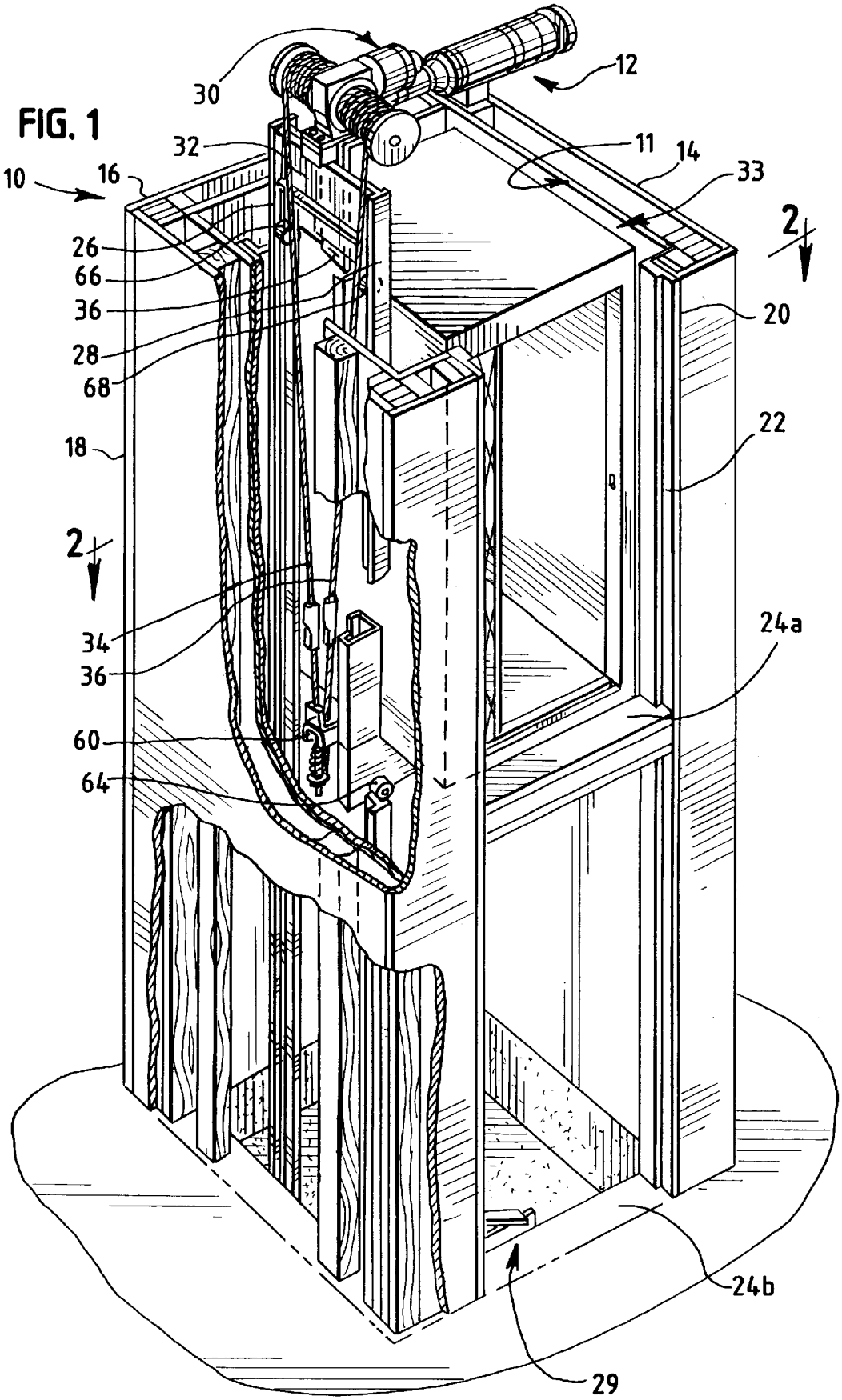
FIG. 1 is a perspective view, partially broken away, showing an elevator system mounted in a hoistway with parts of the hoistway broken away to show various elements.

Referring now to FIG. 1, there is shown structure 10 generally, which defines a hoistway 11 and an elevator system 12. Referring to the hoistway, it is within a residence and defined by a sidewall 14, backwall 16, sidewall 18 and frontwall 20. The frontwall 20 defines an opening 22 and floor portions 24*a* and 24*b* for entrance to and exit from an elevator cab.

The elevator system 12 includes a pair of vertically extending supports or rails 26 and 28 and a drum-type lifting machine 30 for controllably moving a cab structure 33 via a pair of cables 34 and 36 along the rails 26 and 28.

The vertical support rails 26 and 28, as can be seen in FIGS. 1 & 9 are secured to the foundation or floor of the house at the bottom of the hoistway. These rails are positioned against one side of the hoistway and extend from the lowest floor all the way up to the top floor. In this case the support rails are adjacent the sidewall 18. These support rails carry the weight of the lifting machinery, cables, and cab and are only positionally secured to the framing of the house. Thus, the weight of the system and forces incurred thereby are carried by the support rails which are grounded in the foundation of the house.

Referring to FIGS. 10 and 11 there are provided inwardly extending foot assemblies such as 29 generally for supporting the rails such as 28. The rails 26 and 28 rest on a bottom plate 29*a* that extends between the rails. An elongated and lower angle iron member, such as 29*b*, is secured at one end to the bottom plate 29*a* and extends away from the rails and under the cab 33. The angle iron 29*b* is secured to the rail, such as 28, and the floor by various spacers, cross plates, and bolts such as 29*c*, 29*d*, 29*e* and 29*f*. A diagonally positioned brace 29*g* is provided and secured at one end to a rail, such as 28, and at the other end to the far or other end of the angle iron 29*b*. It will be appreciated that similar foot assemblies are provided for both rails and provide additional support for the elevator.

The lifting machinery, as seen in the embodiment in FIG. 1, is mounted to the top of the support rails. The lifting machinery is mounted via a horizontal cross channel 32 which extends between the rails 26 and 28 at the top end thereof. The lifting machinery 30 and connection to the supports are best seen in FIG. 3. The cross channel 32 carries a mounting plate and dampening pad 35 by which the machinery is mounted to the top of channel 32 The machinery 30 is also supported by an L-shaped bracket 36 in which the short leg 36*a* is secured to the base of the lifting machinery and the long leg 36*b* depends therefrom adjacent the rails 26 and 28. The L-shaped bracket can also be thought of as resisting the torque developed by the lifting machinery. The depending leg section 36*b* is held in by two channel shaped dampening members 38 and 40 which are connected to cross plate 37 that is secured to cross channel 32. Each of the dampening clips is channel shaped and includes an outer metal shell, such as 42, within which is positioned urethane dampening material 44. The depending leg 36*b* fits within the channel of the dampening clip. There is an interference fit between the leg 36*b* and the channel of the dampening members 38 and 40. Thus the plate can slide vertically and movement of the plate 36*b* is accommodated in the dampening members. It will be appreciated that vibrations and torques induced by the motor are absorbed at the dampening member 35 or dampening members 38 and 40. Thus, vibrations transmitted to the elevator cab and to the support system are minimized.

The lifting machinery 30 generally includes the motor section 44, a clutch-like brake 46, an automatic brake section 47, a drive shaft 48 and a fly wheel 50. The motor is connected to a transmission or gear box 52, and a pair of grooved drums 56 and 58. The drums are grooved in opposite directions, for example, clockwise and anti-clockwise. The cables 34 and 36 are mounted to the drums 56 and 58 for winding and unwinding. The lower end of each cable is secured to a cross member 60 that supports the floor 62 of the cab 33. The cab also has mounted to it lower rollers, such as 64, that engage the inboard side of a rail such as 28 and upper rollers 66 and 68 that engage the outboard side of the rails. Between the cross support 60, rollers 64, 66 and 68 and cables 34 and 36, the cab 33 is supported in its upward and downward motion on the rails 26 and 28.

It is also seen that the cab 33 is in a sense cantilevered from the rails 26 and 28. Thus operation of the lifting machinery enables the cab 33 to be raised or lowered vertically.

In normal operation the motor 44 is activated, rotates a shaft such as 48, which in turn rotates the elements in the gear box 52 and drums which, in turn, wind or unwind the cable so as to raise or lower the elevator cab. The automatic braking system 47 can activate to grasp the shaft 48 and prevent the drums from rotating, the cables from winding or unwinding and thus, the cab, from moving. The cab is thus locked in place and it may be that the floor 62 of the cab is not in registry with a residence floor 24*a* or 24*b* as in the event of an external power failure. In fact, the cab may be caught between floors and the occupant must then call for help to lower the cab to a safe position and to exit the cab. In the event of an external power failure, the brake 47 is released through a battery powered circuit (not shown and known to one of ordinary skill in the art). The cab, in descending, could accelerate to an unacceptably high velocity, which could harm the occupants or cause damage to the elevator mechanism, especially if there is a terminal impact. However, the clutch-like brake 46, mounted to the motor so as to grasp the shaft which extends therethrough, limits the speed of the motor shaft (and thus the cab) when the cab is descending. For example, when the automatic brake is not activated.

Figure 5:
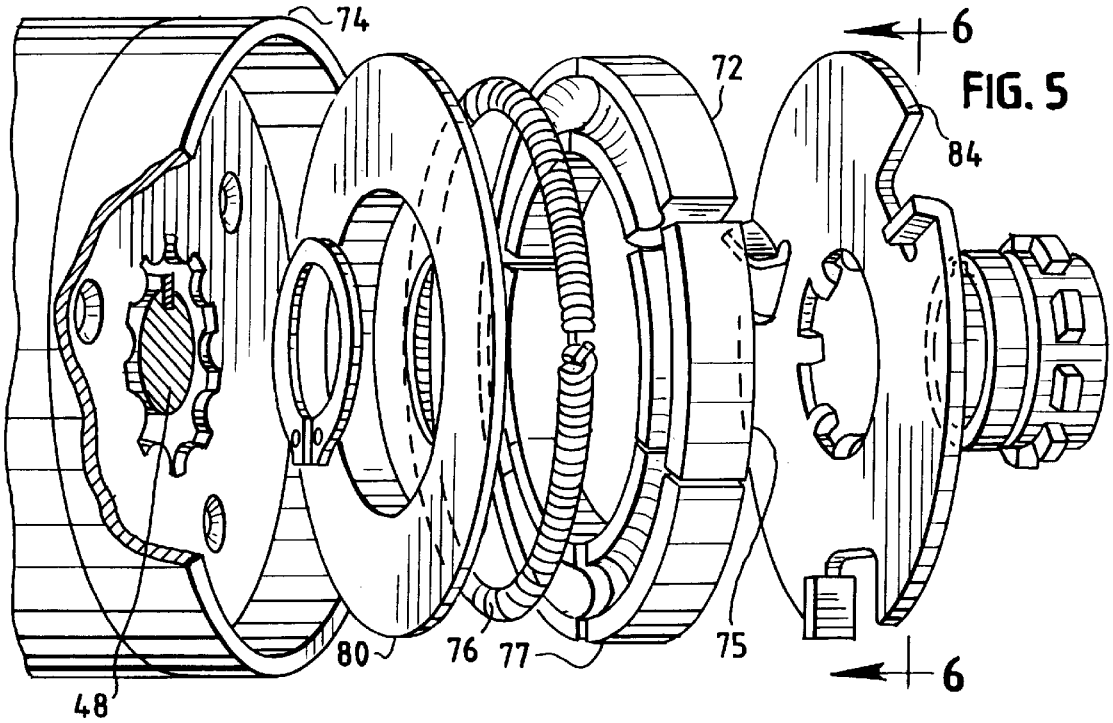
FIG. 5 is an exploded perspective showing the clutch-like brake mechanism for slowing the operation of the motor.
Figure 6:
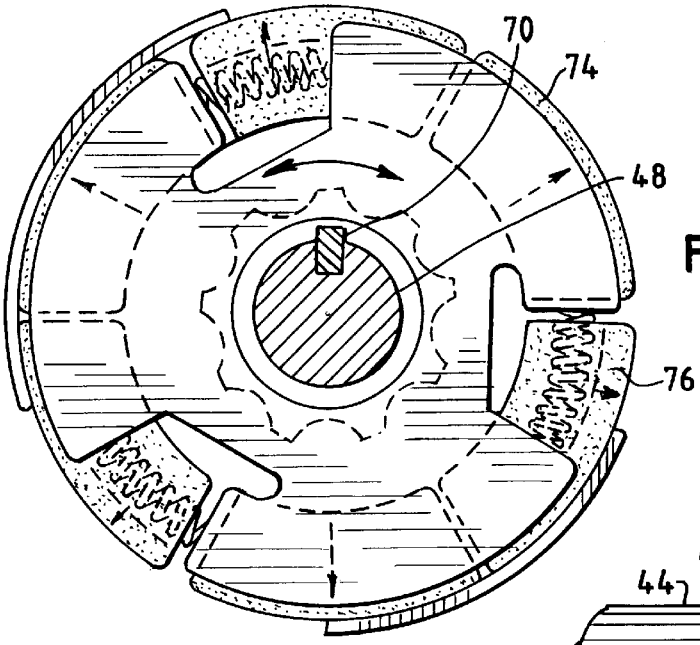
FIG. 6 is an end view of the assembled clutch-like brake, taken substantially along line 6—6 in FIG. 5, showing the manner in which the clutch-like brake operates and the motor's rotation.
Figure 7:
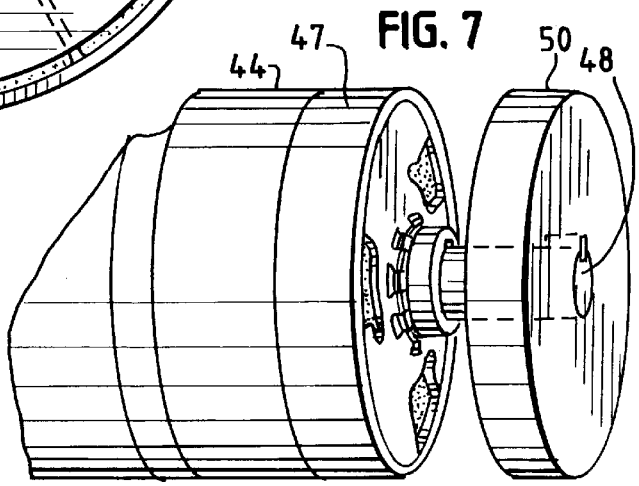
FIG. 7 is a perspective view showing the clutch-like brake mounted in position on the motor relative to other elements of the lifting mechanism.

The clutch-like brake is best seen in FIGS. 5, 6 and 7. The motor section 44 is shown along with the flywheel 50. The motor shaft 48 is shown exiting the motor 44 and passing through the clutch-like brake 46 and engaging the flywheel 50. The clutch-like brake is secured to the shaft via a keyway such as 70 so that the clutch-like brake can rotate with the shaft. In the fully retracted form the clutch-like brake elements such as 72 are radially retracted and do not engage the outer housing or cover 74. The spring 76 holds the elements such as 72 inwardly when the unit is not rotating. However, upon rotation the element 72 moves radially outwardly and against the force of the spring 76. When the element 72 moves sufficiently far outwardly (as the motor shaft rotation exceeds a pre-determined limit) the element 72 engages and slides against the outer cover 74, thus limiting. The speed of rotation of the shaft 48 and to a pre-determined value. The clutch-like brake itself is a sandwich-like construction and includes multiple radially moveable elements such as 72, 75 and 77 or segments which are held in radial position by the spring 70. That assembly is held between the inner plate 80 and outer plate 84.

Thus, if due to power failure the cab stops between floors, the automatic brake is deactivated and the cab lowers itself to the next stop at a safe speed which is limited by the clutch-like brake elements such as 72 engaging the clutch outer cover 74. At the next stop, the automatic brake is reengaged.

Figure 8:
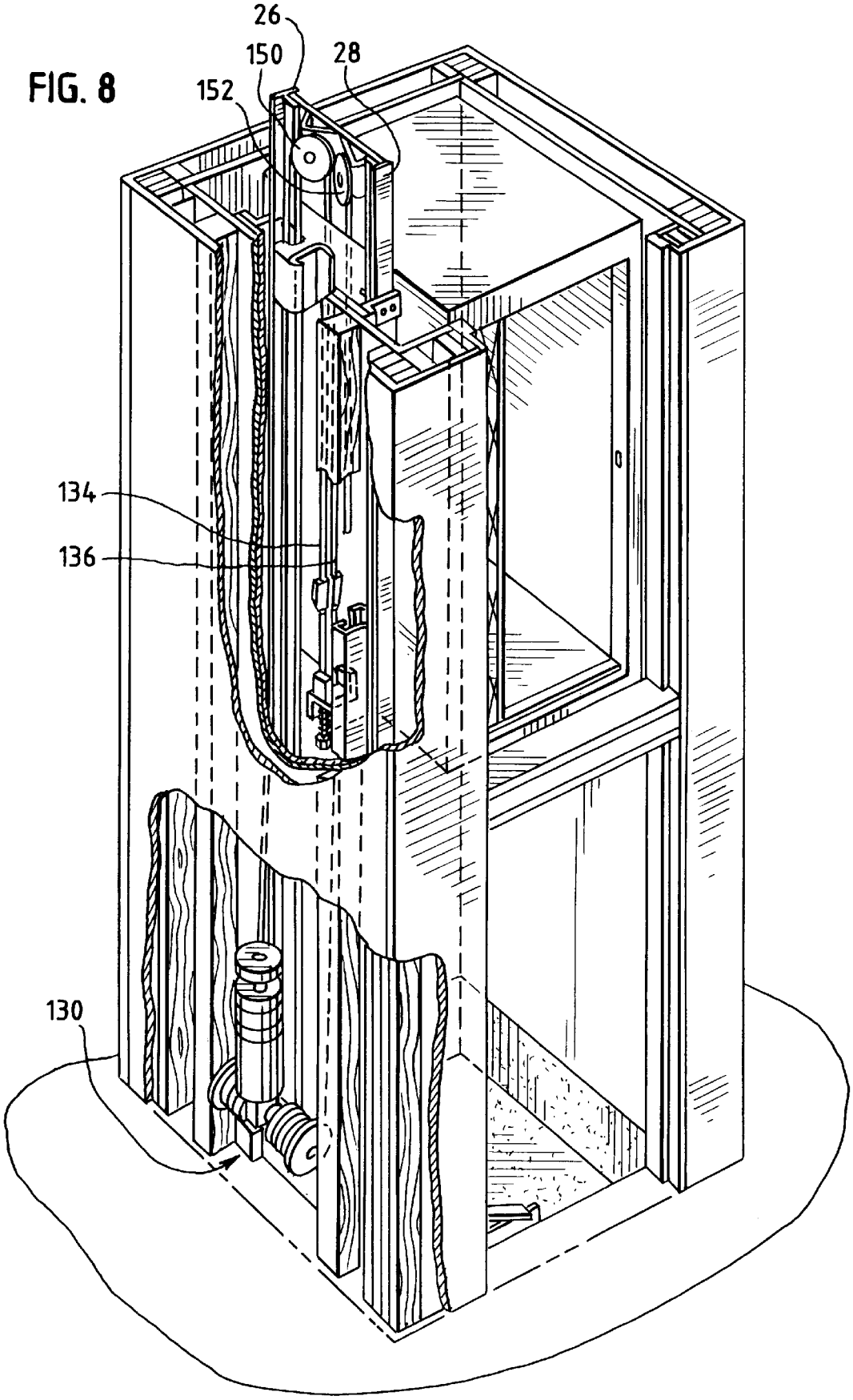
FIG. 8 is a view like FIG. 1, but showing the lifting machine at a lower position and showing a pulley system at the top of the elevator for raising and lowering the elevator cab.

A modified embodiment of this system is shown in FIG. 8. A view line (VL) is shown by the arrow and eye representation. The lifting machinery 130 is similar to the lifting machinery 30, but is positioned at the lower end of the rails 26 and 28. At the top end of the rails are pulleys 150 and 152 about which the cables 134 and 136 are trained.

Lifting machinery 130 is secured to the rails 26 and 28 in a manner similar to that of the device in FIG. 1. Thus, vibrations of the lifting machinery are dampened and their transmission minimized through the system. Other than the positioning of the lifting machinery, the elevator system shown in FIG. 8 is similar to the device in FIG. 1. A side view of the elevator system in FIG. 8 is seen in FIG. 9. Thus, the major difference between the embodiments of FIGS. 1 and 2 and FIGS. 8 and 9 is the positioning of the lifting machinery.

Numerous changes and modifications can be made to the embodiment disclosed herein without departing from the spirit and scope of this invention.

What is claimed is:

1. A cable drum type elevator system for residential or low-rise use which includes:

a vertically extending rail structure for supporting the elevator cab relative to the residence;

an elevator cab mounted to the vertical support construction and moveable thereon in a vertical direction between upper and lower positions by a cable system for controllably moving the elevator cab between the upper and lower positions; and a cable drum-type lifting mechanism secured to the vertical support construction and the elevator cab by the cable system for controllably moving the elevator cab between the upper and lower positions;

wherein the improvement comprises said vertical support construction including a pair of vertically oriented rails, each extending between the upper and lower positions, connected to the lifting mechanism and to the elevator cab and each constructed to carry the load of the lifting mechanism and the elevator cab and each member of the pair mounted to a ground position and connected to the residence structure for positional orientation only; and the lifting mechanism being mounted to the vertical support construction, and there being provided dampening and isolation members positioned between the rails and the lifting mechanism so as to minimize vibrations from the lift mechanism from entering the rails, house cab.

2. A cable drum type elevator system as in claim 1 wherein there is further provided an L-shaped bracket for use in securing the lifting mechanism to the support rails, which L-shaped bracket includes a short leg secured to the mechanism and a long leg being held within the dampening member which includes a pair of channel shaped dampening clips, each of which include a rubber-like vibration dampening element.

3. A cable drum type elevator system for residential or low-rise use which includes:

a support construction for supporting the elevator system relative to the residence;

an elevator cab mounted to the support and moveable thereon in a vertical direction between an upper and a lower position and a lifting mechanism secured to the support and elevator by a cable system for controllably moving the elevator between the upper and lower positions;

wherein the improvement comprises said lifting mechanism including a rotatable drum on which the cable is wound, an electric motor having a motor shaft for rotating the drum so as to wind and unwind the cable, a flywheel associated with the motor shaft, and a clutch-like brake assembly positioned between the motor and flywheel, and engaging said shaft, and including an outer cylindrical housing, and radially extensible elements constructed to engage the outer cylindrical housing upon rotation at a predetermined speed, said elements constructed to reduce rotation beyond a predetermined rotational speed whereby said motor shaft and drum are prevented from rotating beyond a predetermined speed and thus the elevator cannot move at more than a predetermined speed.

4. A cable drum type elevator system for residential or low-rise use which includes:

a vertically extending rail structure for supporting the elevator relative to a residence;

an elevator cab mounted to the rail structure and moveable thereon between upper and lower positions; and a cable drum-type lifting mechanism secured to the rails and to the elevator cab by a cable system for controllably moving the elevator cab between the upper and lower positions;

wherein the improvement comprises said vertically extending rail structure is constructed to carry the elevator cab and lifting mechanism and the rail structure mounted to a ground position and connected to the residence structure for positional orientation only;

wherein the vertical rail structure extends along a side of the elevator cab and the elevator cab is positioned in a cantilever fashion from the support members;

wherein the support structure includes a pair of parallel rails, each rail being an elongated member extending from the ground to above the upper position;

which further includes a foot support assembly secured to the lower end of the rail structure and to the ground;

wherein the support structure includes a pair of rails and a foot support assembly as provided in association with each rail;

wherein said foot support assembly extends beneath the elevator cab;

wherein said lifting mechanism is secured to the vertical rail structure at an upper position whereby the elevator cab is positioned below the lifting mechanism;

wherein the vertical rail structure comprises said support including a pair of vertically oriented rails, each extending between the upper and lower positions, connected to the lifting mechanism and to the elevator cab and each constructed to carry the load of the lifting mechanism and the elevator cab and each member of the pair mounted to a ground position and connected to the residence structure for positional orientation only;

the lifting mechanism being mounted to the support, and there being provided dampening and isolation members positioned between the rails and the lifting mechanism so as to minimize vibrations from the lift mechanism from entering the rails, house or cab;

wherein there is further provided an L-shaped bracket for use in securing the lifting mechanism to the support rails, which L-shaped bracket includes a short leg secured to the mechanism and a long leg being held within the dampening member which includes a pair of channel shaped dampening clips, each of which include a rubber-like vibration dampening element; and wherein said lifting mechanism including a rotatable drum on which the cable is wound, an electric motor having a motor shaft for rotating the drum so as to wind and unwind the cable, a flywheel associated with the motor shaft, and a clutch-like brake assembly positioned between the motor and flywheel, and engaging said shaft, and including an outer cylindrical housing, and radially extensible elements constructed to engage the outer cylindrical housing upon rotation at a predetermined speed, said elements constructed to reduce rotation beyond a predetermined rotational speed whereby said motor shaft and drum are prevented from rotating beyond a predetermined speed and thus the elevator cab cannot move at more than a predetermined speed.

* * * * *